US005612518A

United States Patent [19]

Jaminet et al.

[11] Patent Number: 5,612,518

[45] Date of Patent: Mar. 18, 1997

[54] LINEAR INDUCTION MOTOR DOOR DRIVE ASSEMBLY FOR ELEVATORS

[75] Inventors: Jerome F. Jaminet, South Windsor; Zbigniew Piech, East Hampton; Frank Guliuzza, Jr., Wallingford; Thomas M. McHugh, Farmington; Edward E. Ahigian, West Hartford; Thomas He, Unionville; Richard E. Peruggi, Glastonbury; Thomas M. Kowalczyk, Farmington; Richard E. Kulak, Bristol; David W. Barrett, East Hartland, all of Conn.

[73] Assignee: Otis Elevator Company, Farmington, Conn.

[21] Appl. No.: 225,024

[22] Filed: Apr. 8, 1994

[51] Int. Cl.[6] ..... B66B 13/14

[52] U.S. Cl. ..... 187/316; 49/118

[58] Field of Search ..... 187/316, 289; 49/120, 118, 117; 310/12, 13

[56] References Cited

U.S. PATENT DOCUMENTS

| | | | |
|---|---|---|---|
| 1,986,616 | 1/1935 | Baldwin | 172/290 |
| 3,621,349 | 11/1971 | Reyx | 318/135 |
| 4,450,493 | 5/1984 | Watrous | 360/106 |
| 4,698,876 | 10/1987 | Karita | 16/102 |
| 4,876,765 | 10/1989 | Karita | 16/102 |
| 5,172,518 | 12/1992 | Yoshino | 49/360 |
| 5,235,226 | 8/1993 | Olsen et al. | 310/12 |
| 5,271,181 | 12/1993 | Pietro | 49/118 |
| 5,373,120 | 12/1994 | Barrett et al. | 187/316 |

FOREIGN PATENT DOCUMENTS

| | | | |
|---|---|---|---|
| 0195585 | 9/1986 | European Pat. Off. | E05F 15/18 |
| 0567897 | 11/1993 | European Pat. Off. | E05F 15/18 |
| 0614844 | 9/1994 | European Pat. Off. | B66B 13/14 |
| 3293282 | 12/1991 | Japan . | |

*Primary Examiner*—Robert Nappi

[57] ABSTRACT

The door or doors of an elevator are driven through their opening and closing cycles by one or more linear induction motor (LIM) assemblies in which the primary winding component of the LIM assembly is secured to the elevator cab structure and the LIM secondary component is secured to the cab door. If the cab has two oppositely moving doors, there will preferably be two separate motor drives, one for each door. In one embodiment, the motor components are arranged so as to create a normal force which is horizontal; and in another embodiment, the normal force created is vertical. A primary motor mount bracket is used which secures the primary winding component to the overhead component of the cab structure.

4 Claims, 2 Drawing Sheets

LINEAR INDUCTION MOTOR DOOR DRIVE ASSEMBLY FOR ELEVATORS

TECHNICAL FIELD

This invention relates to a drive or operating assembly for moving elevator cab doors through opening and closing cycles during operation of the elevator.

BACKGROUND ART

Elevator cab doors typically move back and forth on door guide tracks mounted on the elevator cab in order to selectively open and close the entrance from the halls to the cab. When the cab arrives at a hall landing where one desires to enter or exit the cab, the cab doors will selectively link up with the hall doors, and will provide the opening and closing forces for the hall doors. The cab doors (and therefore the hall doors) are driven by a drive assembly which is mounted on the cab assembly.

Present conventional door drive assemblies include a reversible electric motor which is secured to the roof of the cab assembly. The drive motor includes a drive shaft which is selectively rotated in opposite directions, which drive shaft is connected to sets of articulated arms which are also connected to the doors. The articulated arms are connected at one end to a rotor which is driven by the drive motor; and are connected at the opposite end to the doors. In order to move the doors between their open and closed positions with minimal vibration and noise, the articulated arms are typically connected to the doors at a location which is close to the center of gravity of the doors. This tends to suppress rocking motion of the doors on their guide tracks, but it requires relatively excessively long arms. The use of long connecting arms between the drive motor and the doors creates large torque moments on the motor. The motor will thus tend to twist in one direction during opening operation of the doors, and twist in the opposite direction during closing operation of the doors. The torquing forces imposed on the door-actuating motor will thus be imparted to the cab structure. In order to counteract the aforesaid torquing forces, the cab must be structurally reinforced so that the cab will not ultimately be weakened by continual operation of the elevator. Therefore, elevator systems using the aforesaid door operators must employ a structurally reinforced cab that results in increased cab weight and complexity. It would be desirable to utilize an elevator cab door drive system which does not impose substantial torquing forces on the cab during operation of the doors.

DISCLOSURE OF THE INVENTION

This invention is directed to an elevator cab door operating system which need not be connected to the center of gravity of the doors or does not impart significant torquing forces to the cab structure when the doors are opened or closed. The door operating system of this invention is quiet and contains minimal parts. The power needed to move the doors is provided by a linear induction motor assembly (LIM). The LIM includes a primary component and a secondary component. The winding of the primary component is preferably fixed to the overhead beam of the cab, and the secondary is fixed to the door panel. When the elevator has two doors which move away from each other to open the entrance, and toward each other to close the entrance, there will preferably be separate primary and secondary component pairs, one for operating each door.

A LIM of the type used in this invention will create two differently vectored forces during its operation. One of the force vectors created is a thrust force which is perpendicular to the magnetic flux field planes created by the primary winding and its complementary magnetic component. For a three phase motor, the direction of thrust is dependent on the relationship of the phases to each other. The direction of the thrust force is reversed by reversing the phase relationship of two of the three phases. The thrust force is the force which moves the doors through their opening and closing strokes. The other force created by the LIM is the normal force, and it is parallel to the magnetic flux field planes created by operation of the motor, thus it is normal to the direction of the thrust force irrespective of the direction of the thrust vector.

There are several configurations of the generic LIM door operating systems of this invention that can be used to operate the cab doors. In one of the configurations, the LIM normal force will be horizontal; and in the other it will be vertical. One embodiment of the horizontal normal force configuration utilizes an opposed pair of primary windings, while the remaining embodiments of both of the configurations utilize a single primary winding. Each of the single primary winding embodiments employs a complementary magnetic backiron component which completes the magnetic flux field flow path. The magnetic backiron component can be fixed relative to the cab, or it can be movable along with the cab doors. In each embodiment of both configurations, the secondary component is a nonmagnetic electrically conductive member which is fixed to the door or doors and moves with the doors. When an opposed two door system is employed, each door will have a separate secondary secured thereto. The secondary will preferably be a sheet of electrically conductive metal such as copper.

It is therefore an object of this invention to provide an elevator cab door operating system which does not unduly stress the elevator cab structure during operation.

It is a further object of this invention to provide a door operating system of the character described which need not act on the doors at the center of gravity thereof.

It is another object of this invention to provide a door operating system of the character described which provides smooth and quiet opening and closing movement of the doors.

It is an additional object of this invention to provide a door operating system of the character described which has a minimum number of moving parts.

These and other objects and advantages of the invention will become more readily apparent from the following detailed description of several embodiments of the invention when taken in conjunction with the accompanying drawings, in which:

BEST MODE FOR CARRYING OUT THE INVENTION

Figure 1:
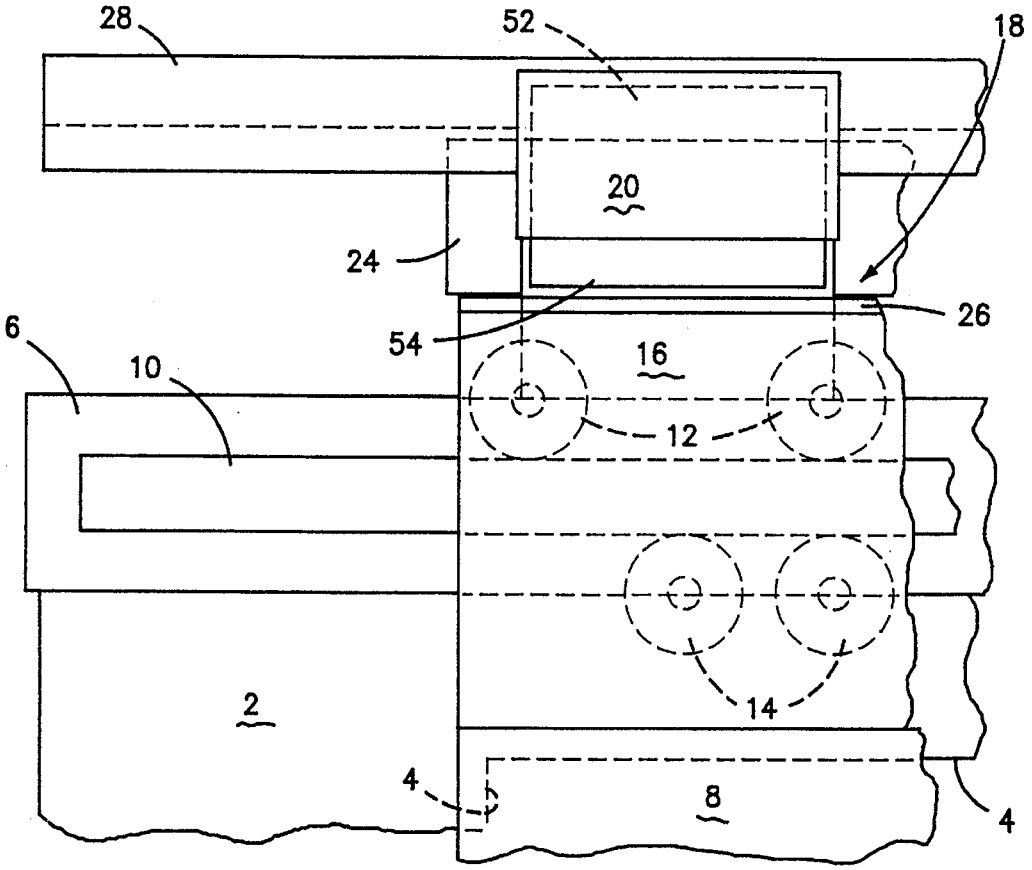
FIG. 1 is a fragmented somewhat schematic elevational view of an elevator cab door showing one embodiment of the invention.
Figure 2:
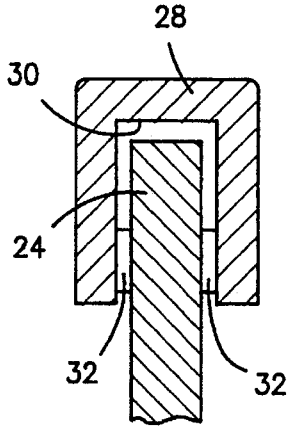
FIG. 2 is a sectional view taken along line 2–2 of FIG. 1.

Referring now to FIG. 1, the cab is denoted generally by the numeral 2 and includes an entrance portal or opening 4 and an overhead beam 6 which is disposed above the entrance portal 4. The cab doors 8 (only one of which is shown) are mounted on a track 10 secured to the overhead 6. The doors 8 move over the track 10 on rollers 12 and 14. The rollers 12 and 14 are mounted on a hanger panel 16 which is the uppermost component of the door 8 and which is rigidly secured to the remainder of the door 8. The rollers 12 are door guide rollers and engage the upper surface of the track 10, and the rollers 14 are upthrust rollers which engage the lower surface of the track 10 so as to prevent tilting of the doors 8 as they move back and forth over the track 10 between their entrance-closed and entrance-open positions. It will be readily appreciated that the position of the door 8 shown in FIG. 1 is the entrance closed position. The LIM door operating assembly is denoted generally by the numeral 18, and includes a support bracket 20 which is mounted on the overhead beam 6. The support bracket 20 provides a mount for the fixed LIM primary winding 52 whereby the latter is fixed to the cab 2. The LIM door-operating assembly 18 also includes a secondary member 24 which is mounted on the door hanger panel 16 by means of a hinge 26 which allows for relative lateral movement between the door 8 and the secondary 24 as the door 8 moves back and forth over the track 10. A secondary-guide member 28 in the form of a channel is mounted on the support bracket 20. The guide member includes longitudinal pocket 30 which receives the upper portion of the secondary 24. The pocket 30 is preferably lined with strips 32 of a low-friction flexible material which contact the opposite side surfaces of the secondary 24, as shown in FIG. 2. A suitable material for forming the strips 32 is the nylon loop component of the hook and loop fastener material known as Velcro®.

Figure 3:
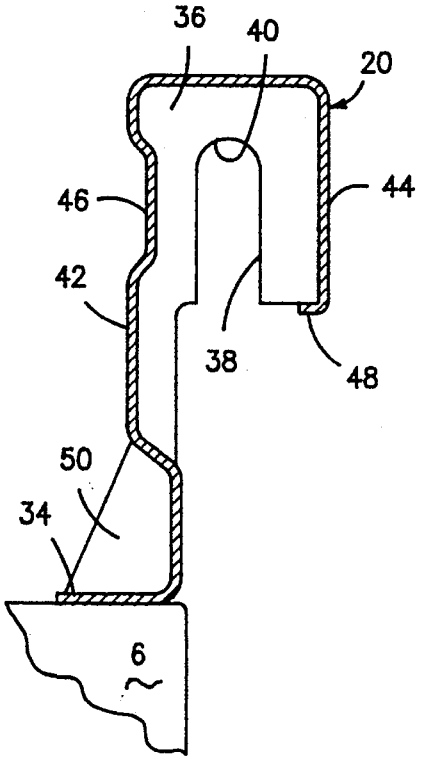
FIG. 3 is a sectional view of the LIM mounting bracket used to secure the primary winding to the cab.

FIG. 3 illustrates one form of the bracket 20 which may be used in conjunction with an embodiment of the invention wherein the entire primary component of the LIM assembly 18 produces a horizontal normal force and is fixed relative to the cab 2. In this embodiment, the bracket 20 includes a flange 34 which serves as a base for the bracket 20 to be secured to the overhead beam 6. The bracket 20 includes a pair of end walls 36 which have vertical slots 38 with arched upper ends 40. The slots 38 allow passage of the secondary element 24 through the bracket 20. The vertical wall 42 nearest the overhead 6 provides a mounting surface for the fixed primary winding (not shown); and an opposite vertical wall 44 provides a mounting surface for the component of the LIM which completes the electromagnetic flux field flow path. The vertical wall 42 has an indentation 46 therein, and the vertical wall 44 has a lower inwardly bent flange 48 thereon. The mounting base 34 has opposed end walls 50 which connect the base 34 with the vertical wall 42. The arches 40; the indentation 46; the flange 48; and the end walls 50 are all useful for resisting the horizontal normal force of the primary component of the LIM and strengthen the bracket 20 so as to stabilize the fixed gap between the two primary components which are mounted on the vertical walls 42 and 44, as will be described in greater detail hereinafter.

Figure 4:
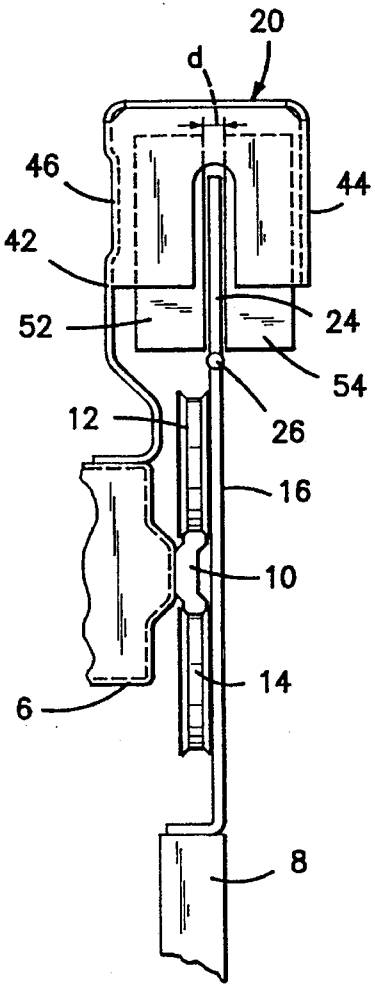
FIG. 4 is an end elevational view of one embodiment of the invention.

Referring now to FIG. 4, one embodiment of a primary assembly for the LIM is shown. In this embodiment, a primary winding component 52 of the primary assembly is mounted on the indented portion 46 of the vertical wall 42 of the bracket 20. The primary winding 52 is selectively supplied with electrical current from a source thereof (not shown) which is mounted on the cab. The second component of this embodiment of the primary assembly is a magnetic backiron member 54 which is mounted on the vertical wall 44 of the bracket 20. The primary winding 52 and the magnetic backiron 54 are both fixed to the bracket 20; and are separated by a predetermined distance d which serves to define a desired gap between the primary winding 52 and backiron 54 and the movable secondary component 24. The fixed primary winding 52 and fixed backiron provide for the necessary electromagnetic flux field which supplies the motive power for the door operating system. The secondary component 24, which is preferably a conductive copper sheet, passes between the primary winding 52 and the backiron 54, with the proper gap between the secondary 24 and the primary elements 52 and 54 being determined by the distance d and the operation of the secondary guide 28 which holds the secondary 24 (as shown in FIG. 2) in its proper position within the gap defined by the distance d. As previously noted, the structure of the bracket 20 serves to prevent narrowing of the distance d which could otherwise result from the normal forces produced by the horizontal electromagnetic flux field. The gaps between the primary components 52 and 54 and the secondary component 24, which are essential to efficient operation of the LIM are thus preserved. The hinge joint 26 prevents lateral oscillations of the door 8 from significantly altering the preset gaps between the secondary component 24 and the primary components 52 and 54 of the LIM. Thus longitudinal deviations of the track 10 that may cause the door 8 to move in or out during opening or closing of the door 8 will not significantly affect LIM operating efficiency.

Figure 5:
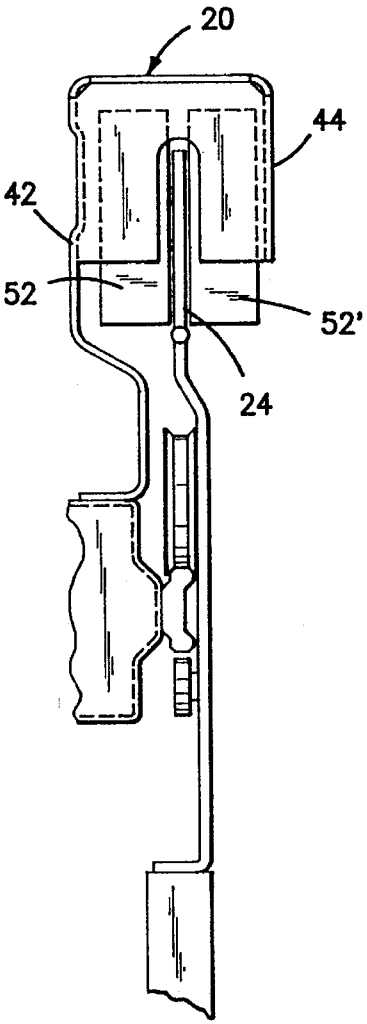
FIG. 5 is an end elevational view of another embodiment of the invention.

Referring now to FIG. 5, there is shown a modification of the embodiment of FIG. 4 which will produce a greater door-driving thrust force in cases where such is needed. In this embodiment of the invention, the primary winding component 52, which is mounted on the vertical wall 42 of the bracket 20, combines with another primary winding component 52' that is mounted on the vertical wall 44 of the bracket 20. Both primary windings 52 and 52' are connected to the electrical current source and supplied with operating current. When the windings 52 and 52' are energized, the door-moving thrust force will be greater than when a backiron is used, so that heavier doors can be opened and closed.

Figure 6:
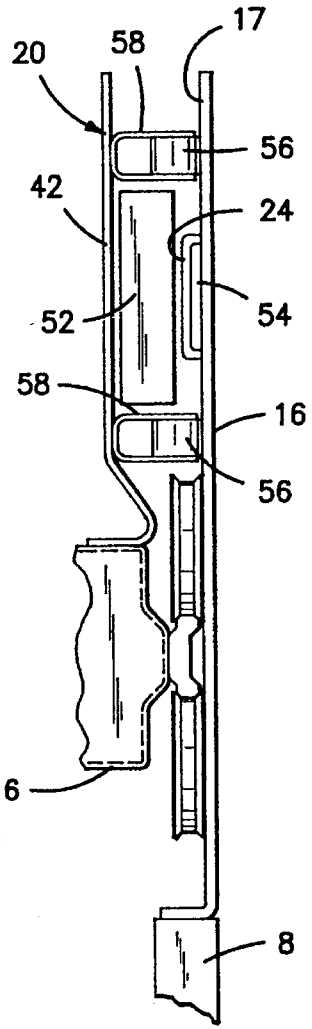
FIG. 6 is an end elevational view of still another embodiment of the invention.

Referring to FIG. 6, another embodiment of a LIM door operating system which produces a horizontal normal force is shown. In the embodiment of FIG. 6, the bracket 20 has a configuration which is somewhat different than the embodiment shown in FIGS. 3–5 in that the second vertical wall 44 is not included. The bracket 20 has a single vertical wall 42 on which the primary winding 52 is mounted. The hanger panel 16 extends upwardly from the door 8 a distance which is approximately equal to the height of the bracket wall 42. The electromagnetic flux field component backiron 54 is fixed to the hanger panel 16, and the copper secondary sheet is fixed to the backiron 54 and faces the primary winding 52. In the embodiment of the invention, it will be understood that the backiron component 54 of the primary assembly extends for the full length of the hanger panel 16. A pair of positioning rollers 56 are mounted on forks 58 secured to the housing wall 42. The rollers 56 engage the surface 17 of the hanger panel 16 and are operable to resist the tendency of the normal force created by the LIM to move the secondary 24 closer to the primary winding 52. The proper operating gap is thus maintained. As previously noted, when the primary winding 52 is energized, the backiron 54 and secondary 24 will be thrust in the appropriate direction according to the phase relationship of current flow through the primary winding 52. It will be appreciated that the thrust forces imparted to the secondary 24 will thrust the door 8, the hanger panel 16 and the backiron 54 through door-opening and door-closing strokes.

Figure 7:
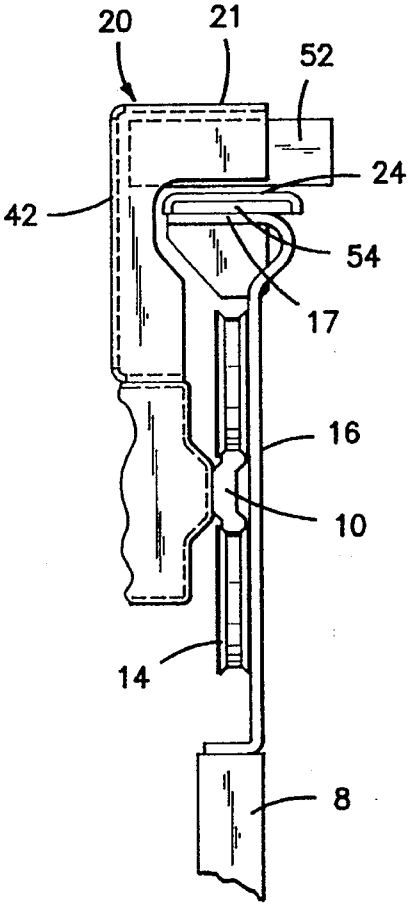
FIG. 7 is an end elevational view of yet another embodiment of the invention.

FIG. 7 shows still another embodiment of the invention which is similar to the embodiment of FIG. 6 in that the backiron 54 moves with the door 8; but different from the embodiments of FIGS. 1–6 in that the normal force created by the LIM is vertical, rather than horizontal. In the embodiment of FIG. 7, the bracket 20 includes the aforesaid vertical wall 42 and an upper horizontal terminal wall 21 which is perpendicular to the vertical wall 42. The primary winding component 52 is mounted on the undersurface of the horizontal wall 21. The hanger panel 16 on the door 8 terminates in a horizontal flange 17 which extends toward the vertical wall 42 on the bracket 20. The primary backiron component 54 is mounted on the hanger panel flange 17, and the copper secondary member 24 is mounted on the backiron 54. As previously noted in the embodiment, the backiron component 54 moves with the door 8 and the secondary 24. The embodiment shown in FIG. 7 does not require a secondary or other component guide since the gap between the primary winding 52 and the secondary 24 can be controlled and maintained relatively constant by the weight of the door panel 8. Since the electromagnetic flux field flows along vertically oriented lines through the secondary 24, the normal force created between the primary winding 52 and the backiron 54 will tend to pull the backiron 54 upwardly toward the primary winding 52. This upwardly directed attractive force will be offset, as noted, by the weight of the door 8 and also by the upthrust rollers 14 engaging the lower surface of the track 10.

It will be readily appreciated that the LIM elevator cab door operating system of this invention will effectively open and close the cab and hall doors in an elevator without imparting potentially troublesome mechanical stresses to the cab structure. The door drive system has minimal moving parts, operates efficiently and quietly, and can be readily serviced and maintained in the field. The LIM can be oriented on the cab so as to create a horizontal normal force, or a vertical normal force. The primary winding of the LIM is fixed to the cab structure, preferably to the cab overhead beam; and the secondary of the LIM is secured to the cab door being driven by the LIM. The electromagnetic flux field flow path is completed by a magnetic backiron component which is disposed opposite the primary winding on the side of the secondary facing away from the primary winding. The backiron can be fixed relative to the primary winding, or can move with the secondary. The operating system of this invention replaces the multi-component, stress-creating and noisy articulated arm door operators widely used in the industry today.

Since many changes and variations may be made in the invention, it is not intended to limit the invention otherwise than as required by the appended claims.

What is claimed is:

1. An elevator cab assembly having a cab with a passenger entrance along with a cab door operable to close and open at least a portion of said passenger entrance; and a cab door operating system, said assembly comprising:

a) a linear induction motor (LIM) primary winding component fixed to the cab above the passenger entrance;

b) a complementary LIM primary component disposed opposite said primary winding component and separated therefrom by a predetermined gap;

c) a LIM secondary component secured to said cab door and interposed between said complementary primary component and said primary winding component, said secondary component extending through said gap; and d) a secondary component guide mounted on said cab and operable to engage said secondary component to maintain a desired spacing between said secondary component and said primary components as said door moves to open and close said passenger entrance, said secondary component guide extends the length of the door.

2. The elevator cab assembly of claim 1 wherein said guide is a channel-shaped member which receives an edge of said secondary component and prevents said secondary component from substantially deviating toward either of said primary components.

3. The elevator cab assembly of claim 2 further comprising a low friction liner in said channel-shaped member which liner contacts opposite sides of said secondary component.

4. The elevator cab assembly of claim 1 wherein said guide comprises roller means for contacting a side surface of said secondary component.

* * * * *